US009206612B2

(12) United States Patent
Gosling et al.

(10) Patent No.: US 9,206,612 B2
(45) Date of Patent: Dec. 8, 2015

(54) TRIM CONNECTION SYSTEMS AND METHODS

(71) Applicant: Dirtt Environmental Solutions, Ltd., Calgary (CA)

(72) Inventors: Geoff Gosling, Calgary (CA); Mogens Smed, DeWinton (CA)

(73) Assignee: DIRTT Environmental Solutions, LTD, Calgary (CA)

( * ) Notice: Subject to any disclaimer, the term of this patent is extended or adjusted under 35 U.S.C. 154(b) by 0 days.

(21) Appl. No.: 14/249,260

(22) Filed: Apr. 9, 2014

(65) Prior Publication Data

US 2014/0215939 A1 Aug. 7, 2014

Related U.S. Application Data

(63) Continuation of application No. 14/112,029, filed as application No. PCT/US2013/044760 on Jun. 7, 2013.

(60) Provisional application No. 61/658,382, filed on Jun. 11, 2012.

(51) Int. Cl.

| | |
|---|---|
| ***E04F 19/02*** | (2006.01) |
| ***E06B 1/34*** | (2006.01) |
| ***E06B 1/60*** | (2006.01) |

(52) U.S. Cl.

CPC . *E04F 19/02* (2013.01); *E06B 1/34* (2013.01); *E06B 1/6015* (2013.01)

(58) Field of Classification Search

CPC ... E04F 19/02; E04F 19/1495; E04F 19/1463; E04F 19/1459; E04F 19/1481; E04F 13/06; E06B 1/62; E06B 1/342; E06B 1/52; E06B 2001/622; E06B 2001/628; E06B 3/88; E06B 1/6015; E06B 1/34

USPC ..... 52/718.01, 718.04, 718.06, 718.03, 52/716.1, 716.8, 717.01, 287.1, 211, 212

See application file for complete search history.

(56) References Cited

U.S. PATENT DOCUMENTS

| | | | | | |
|---|---|---|---|---|---|
| 3,464,177 | A | * | 9/1969 | Amato | 52/288.1 |
| 3,707,061 | A | * | 12/1972 | Collette et al. | 52/288.1 |
| 4,296,583 | A | * | 10/1981 | Egenlauf | 52/717.01 |
| 4,920,714 | A | * | 5/1990 | Sease | 52/222 |
| 6,260,321 | B1 | | 7/2001 | Rudduck | |
| 6,345,480 | B1 | * | 2/2002 | Kemper et al. | 52/395 |
| 6,786,016 | B1 | * | 9/2004 | Wood | 52/290 |

(Continued)

FOREIGN PATENT DOCUMENTS

| | | |
|---|---|---|
| JP | 2004176258 | 6/2004 |
| KR | 1020120045760 | 5/2012 |

OTHER PUBLICATIONS

International Search Report and Written Opinion for PCT/US2013/044760 mailed Jun. 7, 2013.

*Primary Examiner* — Jessica Laux

(74) *Attorney, Agent, or Firm* — Workman Nydegger

(57) ABSTRACT

Implementations of the present invention provide systems, methods, and apparatus for securing trim to interior and/or exterior walls and wall portions. In particular, at least one implementation includes a system for connecting and securing trim elements without additional adjustments and/or fitting thereof. Moreover, the system for connecting and securing trim elements can improve accuracy and increase the speed of assembly, thereby reducing time and expense associated with installing trim to a building.

15 Claims, 5 Drawing Sheets

(56) References Cited

U.S. PATENT DOCUMENTS

| | | | | |
|---|---|---|---|---|
| 7,574,836 | B2 * | 8/2009 | Wesolowska | 52/288.1 |
| 7,870,697 | B2 * | 1/2011 | Galas | 52/211 |
| 7,926,430 | B2 | 4/2011 | Bakker | |
| 7,958,683 | B2 | 6/2011 | Abusada | |
| 8,033,059 | B2 | 10/2011 | Contois | |
| 8,601,749 | B2 | 12/2013 | Huene | |
| 8,613,168 | B2 | 12/2013 | Huene | |
| 8,615,936 | B2 | 12/2013 | Huene | |
| 2004/0182040 | A1 | 9/2004 | Schiedegger | |
| 2006/0207197 | A1 * | 9/2006 | Anderson | 52/211 |
| 2008/0184637 | A1 | 8/2008 | Miller | |
| 2011/0179733 | A1 * | 7/2011 | Picken | 52/242 |
| 2014/0157720 | A1 | 6/2014 | Von Hoyningen Huene et al. | |

* cited by examiner

TRIM CONNECTION SYSTEMS AND METHODS

CROSS-REFERENCE TO RELATED APPLICATIONS

The present application is a Continuation of Ser. No. 14/112,029, filed Oct. 15, 2013, entitled "Trim Connection Systems and Methods" which is a 35 U.S.C. §371 U.S. National Stage of PCT Application No. PCT/US2013/044760 filed Jun. 7, 2013, entitled "Trim Connection Systems and Methods," which claims priority to U.S. Provisional Patent Application No. 61/658,382, filed Jun. 11, 2012, entitled "Trim Connection Systems and Methods." The entire content of each of the aforementioned patent applications is incorporated herein by reference.

BACKGROUND OF THE INVENTION

1. The Field of the Invention

This invention relates to systems, methods, and apparatus for securing trim to interior and exterior portions and walls of a building.

2. Background and Relevant Art

A typical building construction involves preparing and constructing walls as well as other building components at a build site. Additionally or alternatively, a builder may choose to use prefabricated wall modules to construct interior and/or exterior walls of the building. Once the walls are constructed, a typical building may incorporate additional features on the walls. For example, ordinarily, a building includes at least one door and one or more windows.

Furthermore, the builder may choose to attach additional trim to the walls of the building. For instance, additional trim can conceal seams, edges, and openings in the walls, which accommodate doors, windows, etc. A typical installation of trim (e.g., installation of a doorframe or decorative trim surrounding the doorframe) involves cutting, fitting, shimming, and adjusting the trim of the wall, which can take a substantial amount of time and effort to complete. Furthermore, the installer may need to have sufficient skill to correctly and accurately perform the installation.

Also, in a typical installation of trim, the installer nails or screws the trim to the wall. Thus, the installer may have to conceal the nails and screws, e.g., for aesthetic reasons. Such concealment also can be time-consuming and may require an experienced installer. Additionally, the concealment may not always be perfect, and an occupant of the building may see undesirable marks on the trim.

Accordingly, there are a number of disadvantages in systems and methods for securing trim to a wall that can be addressed.

BRIEF SUMMARY OF THE INVENTION

Implementations of the present invention provide systems, methods, and apparatus for securing trim to interior and/or exterior walls and wall portions. In particular, at least one implementation includes a system for connecting and securing trim elements without additional adjustments and/or fitting thereof. Moreover, the system for connecting and securing trim elements (i.e., quick-connect trim system) can improve accuracy and increase the speed of assembly, thereby reducing time and expense associated with installing trim to a building.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
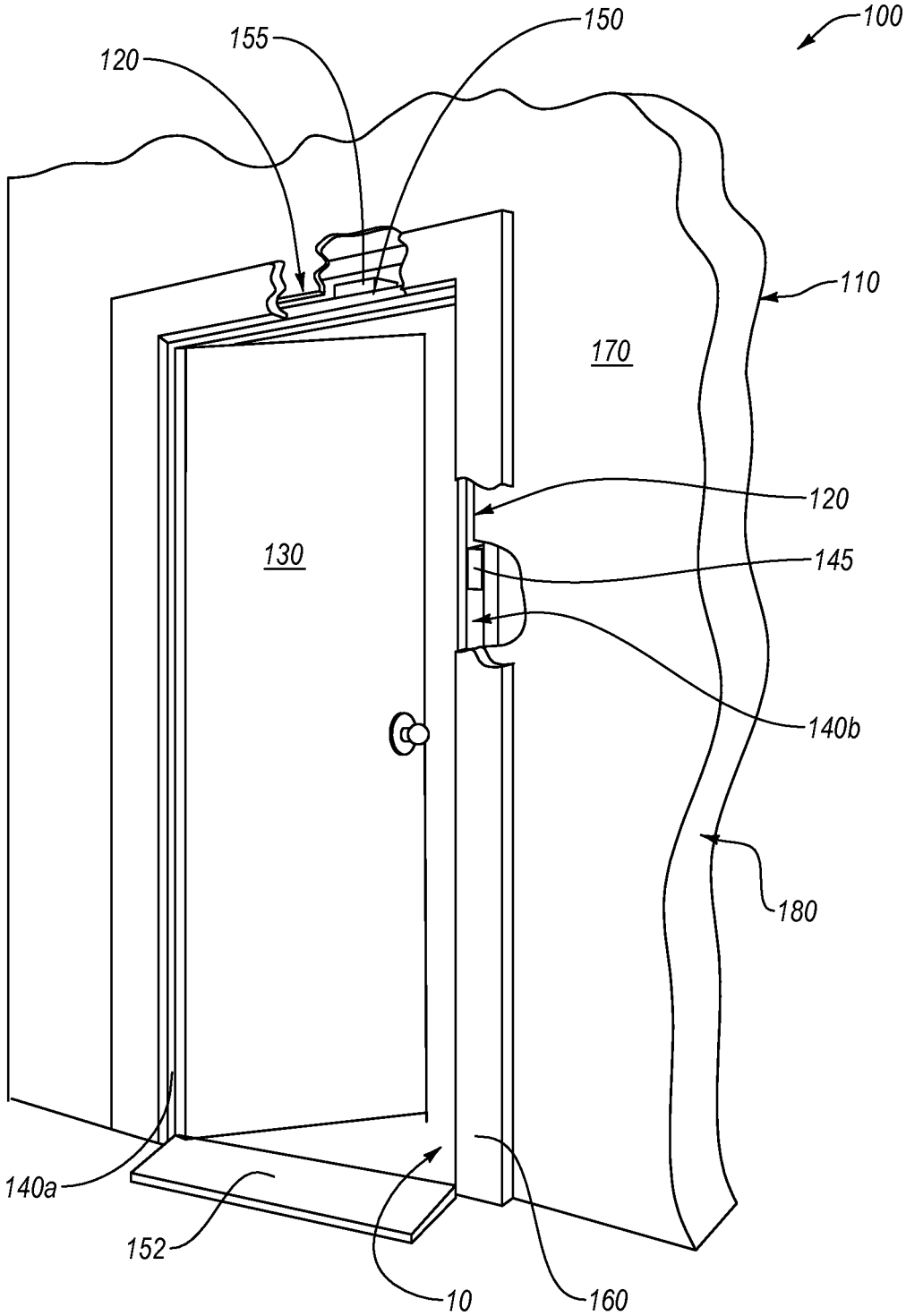
FIG. 1 illustrates a perspective view of a quick-connect trim system in accordance with an implementation of the present invention.

Implementations of the present invention provide systems, methods, and apparatus for securing trim to interior and/or exterior walls and wall portions. In particular, at least one implementation includes a system for connecting and securing trim elements without additional adjustments and/or fitting thereof. Moreover, the system for connecting and securing trim elements (i.e., quick-connect trim system) can improve accuracy and increase the speed of assembly, thereby reducing the time and expense associated with installing trim to a building.

In one or more implementations, the trim connection system also can provide aesthetic as well as structural support to the building. In one example, the quick-connect trim system can conceal unfinished edges of the building's walls or cladding. For instance, the quick-connect trim system can conceal edges of the openings created for building components and/or elements, such as doors, windows, etc. As such, the quick-connect trim system also can facilitate connection of structural elements within the openings of the building's walls. For example, the quick-connect trim system can facilitate securing casing or trim for windows and doors. Furthermore, the quick-connect trim system also can conceal other unfinished edges of the walls, such as edges at the top portions of the walls that may otherwise remain exposed under the roof of the building, wall corners, etc.

Additionally or alternatively, the quick-connect trim system can allow an installer to connect the trim to the building without nails or screws. In particular, in one or more implementations, the installer can position connectors of the quick-connect trim system on an inner side of the trim and snap the trim into place. Thus, the trim may have no visible marks from fasteners connecting the trim to the building's walls, and the installer may not need to conceal any fasteners that may otherwise connect the trim to the building's walls. Consequently, the quick-connect system can reduce the amount of time required to complete trim installation.

As a preliminary matter, implementations of the present invention are described herein primarily with reference to trim, such as for windows and door casings. One will appreciate, however, that "trim" as used herein comprises not only trim for windows and door casings but any type of trim, casing, or other building finishing product. For example, the quick-connect trim system described herein can be used with all types of trim including, but not limited to, crown molding, baseboards, casing, chair rail, picture rail, wall frame molding, soffit, fascia, drip edge, eave trim, base trim, rake trim, angle trim, corner trim, and other types of trim.

In one or more implementations, the present invention comprises modular walls (such as SIP walls or ICF walls) that may be prefabricated, and which can include preinstalled wall-mounted connectors. The wall-mounted connectors can mate with trim-mounted connectors on trim components, allowing trim to be added to the modular walls quickly, accurately, and with minimal labor. In one or more implementations, the trim is prefabricated such that it can be immediately attached to the modular walls without having to measure, cut, or otherwise modify the trim at the construction site. In further implementations, the trim is attached to the modular walls at the factory. Furthermore, a builder can attach connectors to conventional trim cut on site and connect the conventional trim to the preinstalled connectors on a modular wall.

As described above, at least one implementation includes the quick-connect trim system for concealing openings in the building's walls, which accommodate doors, windows, etc. For convenience of description, reference will be made to "walls" generally. It should be appreciated that such references intend to encompass any types of interior and exterior walls of a building, including modular and non-modular walls. For example, as illustrated in FIG. 1, the quick-connect trim system 100 can mount in an opening 10 formed within the building's wall 110. More specifically, the quick-connect trim system 100 can conceal one or more edges, such as unfinished edges 120 of the opening 10 in the wall 110.

It should be appreciated that the unfinished edges 120 may be formed by or define (at least partially) any number of components or elements of the wall 110. For example, the opening 10 in the wall 110 may form one or more unfinished edges 120 on a cladding layer 170 (e.g., siding) secured to the wall 120. Similarly, on an interior side of the wall 110, the opening 10 may form unfinished edges on drywall or similar covering (not shown) secured to the wall 110. In any event, the quick-connect trim system 100 may conceal any number of unfinished edges, such as the unfinished edges 120.

Additionally, the quick-connect trim system 100 can provide structural support to one or more elements or components mounted within the opening 10 in the wall 110. For instance, the quick-connect trim system 100 can provide structural support and connection for a door 130. In particular, the quick-connect trim system 100 can include various elements of trim, such as one or more side jambs, such as side jambs 140*a*, 140*b*, a head jamb 150, a bottom threshold 152, and combinations thereof. Additionally, the quick-connect trim system 100 can include exterior casing trim 160 as well as an interior casing trim (not shown), which can conceal unfinished edges 120 of the wall 110.

Accordingly, to form a door opening as well as to install the door 130 within such opening, the installer can secure the side jambs 140*a*, 140*b* and the head jamb 150 within the opening 10 to the wall 110 of the building. In some instances, the installer may place side spacers, such as a side spacer 145, between the side jambs 140*a*, 140*b* and a portion of the wall 110 (e.g., a structural beam of the wall). Similarly, the installer also may place header spacers, such as a header spacer 155, between the head jamb 150 and a portion of the wall (e.g., a wall header).

For instance, a trim connector assembly (described below), can allow the installer to secure the side jambs 140*a*, 140*b* to the wall 110. Additionally, the trim connector assembly also can secure the head jamb 150 to the wall 110. The trim connector assembly also can secure the exterior casing trim 160 and the interior casing trim to the wall 110.

In one or more implementations, the trim connector assembly can include a wall-mounted connector and a trim-mounted connector (described in greater detail below in connection with FIGS. 2, 2A, 2B, 3, and 5), which can couple or secure one or more pieces of the trim, such as the side jambs 140*a*, 140*b*, head jamb 150, exterior casing trim 160, to the wall 110. Particularly, the installer can secure the wall-mounted connector to an internal or an external portion of the wall 110. For instance, the installer can secure the wall-mounted connector to an outer surface or to an inner surface of the wall 110.

It should be appreciated that the wall 110 can have various configurations and can comprise various layers and structures. For example, an interior structural portion 180 of the wall 110 can comprise one or more structural insulated panels (SIPs), which have exterior and interior sheaths encasing insulation material. Additionally or alternatively, the builder may use insulating concrete forms (ICFs) to form the interior structural portion 180 of the wall 110. Moreover, the builder may stick-build the interior structural portion 180 of the wall 110.

Thus, in at least one implementation, the builder or installer can secure the wall-mounted connectors to any portion of the interior structural portion 180 of the wall 110. For instance, the installer can secure one or more wall-mounted connectors to the exterior and/or interior panels of a SIP wall. Furthermore, the builder can secure and/or incorporate the wall-mounted connectors to/into the interior structural portion 180. In one example, the interior structural portion 180 may include a beam or a support that can secure the wall-mounted connectors.

In some implementations, the wall 110 can have the interior structural portion 180 that includes various reinforcements, such as steel reinforcements. For instance, as mentioned above, the wall 110 can be an ICF wall, which may include steel reinforcements encased in concrete. Hence, in some implementations, the wall-mounted connectors may couple to or form a part of the steel reinforcements within the ICF wall.

As described above, in addition to the interior structural portion 180, the wall 110 can include one or more cladding layers 170. For example, the wall 110 can include an exterior cladding layer 170, such as stucco, siding, etc. The wall 110 also can include an interior cladding layer (not shown), such as drywall, wood paneling, or modular wall paneling. Accordingly, the wall-mounted connectors also can at least partially couple to the cladding layers 170 (i.e., to the interior and/or exterior cladding layers 170).

The trim-mounted connectors may couple to or form a part of the particular piece of trim that the builder intends to attach to the wall 110. For example, the side jambs 140*a*, 140*b* and the head jamb 150 can include the trim-mounted connectors on inner portions thereof. In other words, the trim-mounted connectors can detachably couple to and/or form a portion of the side jambs 140*a*, 140*b* and the head jamb 150 that faces and couples to the wall 110. In at least one implementation, the trim-mounted connectors may be integrated with a particular piece of trim. In any event, the installer can connect the trim, such as the side jambs 140*a*, 140*b* and the head jamb 150 to the wall 110 by connecting trim-mounted connectors to the wall-mounted connectors.

Additionally or alternatively, a manufacturer can preset the wall-mounted connectors on the wall 110, such as a SIP wall, before providing the wall at an assembly site. In other words, in one or more implementations, the wall 110 may be a modular wall that may be provided at the assembly site together with the wall-mounted connectors. Accordingly, the builder can receive a prefabricated wall 110, which can have one or more necessary openings for installation of doors, windows, etc., and can include the wall-mounted connectors for attaching desired trim in and/or around the openings as well as at various locations that may have unfinished edges. A prefabricated wall 110 that incorporates the wall-mounted connectors can obviate the need for adjusting, fitting, and/or shimming various trim, intended for the building. Instead, the builder can connect trim directly to the wall using the trim connector assembly and can avoid making subsequent adjustments.

Similarly, the manufacturer can secure and/or incorporate the trim-mounted connectors to the trim at the factory. Thus, the builder can choose the appropriate trim and can connect such trim to the wall 110 without fitting, shimming, or making other adjustments. Moreover, the manufacturer can arrange the wall-mounted connectors and the corresponding trim-mounted connectors such that only a particular piece of trim can couple to the wall 110 at a predetermined location.

For instance, different pieces of trim, such as a left side jamb 140*a* and a right side jamb 140*b* can have different spacing and/or arrangements of trim-mounted connectors. The wall 110 also can have correspondingly spaced wall-mounted connectors, such that the left side jamb 140*a* can only couple to a left side of the opening in the wall 110, and the right side jamb 140*b* can only couple to the right side of an opening in the wall 110. Implementations also can include the trim-mounted connectors that have different configurations, such as size, shape, etc., on different pieces of trim and correspondingly shaped, sized, etc., wall-mounted connectors on the wall 100. Accordingly, the shape, size, and/or other features of the trim- and wall-mounted connectors can allow connecting the trim-mounted connectors only at predetermined locations to corresponding wall-mounted connectors (i.e., can force connecting trim at specific locations on the wall 110).

Additionally or alternatively, the builder can secure the wall-mounted connectors to the wall 110 at the build site. Similarly, the builder also can secure the trim-mounted connectors to the trim at the build site. Accordingly, after securing the respective wall-mounted connectors to the wall 110 and the trim-mounted connectors to the trim, the builder can couple the trim-mounted connectors to the wall-mounted connectors, thereby connecting the trim to the wall 110.

In at least one implementation, the present invention extends to a pre-fabricated building shell. In particular, such implementations can include a system of trims that can be applied to the shell structure after assembly of the walls and application of wall cladding (such as siding). Such a system can allow for maximum speed of shell assembly without time gaps in the process for fine tuning fenestration openings, corner conditions, roof line conditions.

Once the pre-fabricated walls are in place and cladded (whether cladding was applied in factory or on-site after stand-up of wall or wall modules) the trim is applied easily and securely through the quick-connect trim system, which can vary in design dependent on the building structure material (wood stud, steel stud, SIP, ICF etc.). The trim system not only serves as an aesthetic finish trim between adjacent modules, fenestration edges, corners and related cladding, but also can provide functional structure and/or support where required (such as door frame trim ready to accept door mounting, or window frame trim ready to accept window connections, and sealing systems etc.). Thus, implementations of the present invention can provide the ability to add trim components after the stand-up or modular construction of the shell and application of cladding. Such trim components are easily attached, accurately located, and functionally operative.

Figure 2:
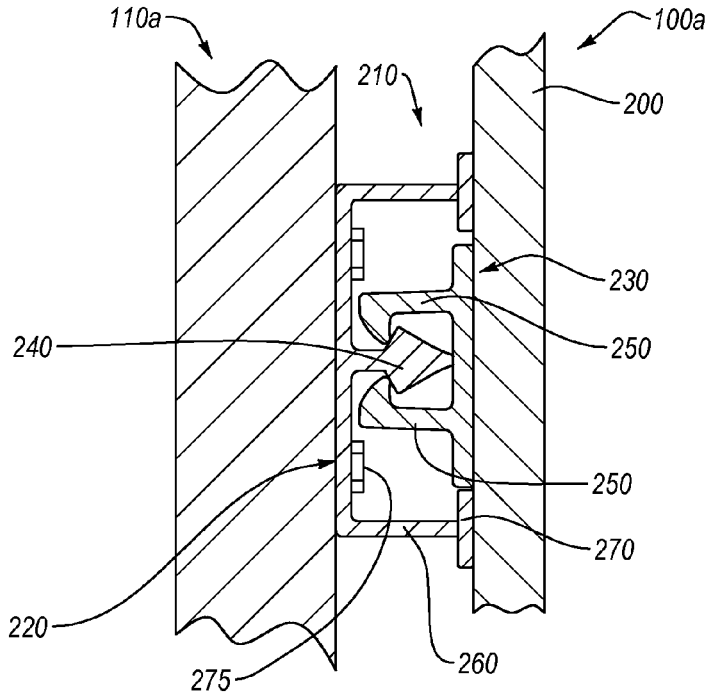
FIGS. 2, 2A and 2B illustrate cross-sectional views of trim connector assemblies in accordance with implementations of the present invention.

Thus, the quick-connect trim system can provide a quick, easy, accurate, and repeatable connections for connecting various trim to the interior structural portion 180 and/or cladding layers (e.g., cladding layer 170) of the wall 110. FIG. 2 illustrates one implementation of a quick-connect trim system 100*a*. Except as otherwise described herein, the quick-connect trim system 100*a* and its materials, elements, or components can be similar to or the same as the quick-connect trim system 100 (FIG. 1) and its respective materials, elements, and components.

Accordingly, the quick-connect trim system 100*a*, as described above, can provide connection for an element of trim 200 (such as the side jambs 140*a*, 140*b*, the head jamb 150, bottom threshold 155, the exterior casing trim 160, etc., illustrated in FIG. 1) to the wall 110*a*. For convenience of description, references to walls are intended to encompass the interior structural portion and/or cladding layers (e.g., cladding layer 170) of the wall, as may be applicable in a particular application. Thus, reference to connection of the element of trim 200 to the wall 110*a* includes connecting the trim 200 to the structural portion and/or cladding layers of the wall 110*a*, unless specified otherwise. Particularly, a trim connector assembly 210 can couple the trim 200 to the wall 110*a*.

In one or more implementations, the trim connector assembly 210, as described above, can include a wall-mounted connector 220 and a trim-mounted connector 230. The wall-mounted connector 220 can receive and secure at least a portion of the trim-mounted connector 230. For instance, the trim-mounted connector 230 can have one or more coupling features 250, which can receive and secure one or more corresponding coupling features 240 of the wall-mounted connector 230.

In at least one implementation, the coupling features 240 can have one or more undercutting portions that can secure one or more corresponding undercutting portions of the coupling features 250. Furthermore, the coupling features 250 can include resilient material, which can allow the coupling features 250 to flex (e.g., outward) from an original position to a flexed position. The coupling features 250 also can at least partially flex toward their respective original positions, to secure the coupling feature 240. Accordingly, one or more coupling features 240 can snap into one or more coupling features 250.

In alternative implementations, the coupling features 250 can snap into the coupling features 240. In other words, corresponding shapes and/or features of the coupling features 240 and the coupling features 250 are mutually interchangeable. In any event, the coupling features 240 and 250 can provide a snap-in connection between the respective wall-mounted connector 220 and the trim-mounted connector 230.

Additionally, the trim connector assembly 210 can include one or more tensioning members 260, which can provide additional stability for the trim 200 with respect to the wall 110*a*. More specifically, the wall-mounted connector 220 (see FIGS. 2, 2B) and/or the trim-mounted connector 230 (see FIGS. 2A, 2B) can incorporate one or more tensioning members 260, either as a separate feature or integrated into their respective coupling features 240, 250. For instance, the tensioning members 260 can be a separate feature on the wall-mounted connector 220. Additionally, the tensioning members 260 can include a foot 270, which can have a greater area than the rest of the tensioning member 260, and which can press against a portion of the trim 200.

Accordingly, the tensioning members 260 can press against the trim 200 (see FIGS. 2, 2B) or the wall 100*a* (see FIG. 2A), thereby placing the coupling features 240 and 250 in tension one with the other. In other words, the tensioning members 260 may be flexibly compressed between the trim 200 and the wall 110*a*. Placing the coupling features 240 and 250 in tension one with the other, can provide an improved connection and can firmly secure the trim 200 to the wall 110*a*. Hence, when installing the trim 200, the builder can compress the tensioning members 260 and engage and couple the coupling features 240 of the wall-mounted connector 220 to the coupling features 250 of the trim-mounted connector 230. Moreover, after coupling the wall-mounted connector 220 to the trim-mounted connector 230, the tensioning members 260 can at least partially expand, thereby forcing the coupling features 240 to press against the coupling features 250.

It should be appreciated that the trim 200 may be a conventional element of trim that otherwise may be secured with conventional methods (e.g., nails, screws, etc.) or a custom made trim. Hence, the trim-mounted connector 230 may attach to the trim 200 with fasteners, such as screws, nails, etc. Additionally or alternatively, the trim-mounted connector 230 may be integrated into a custom made trim.

Similarly, the builder can secure the wall-mounted connector 220 to various portions of the wall 110*a*. Moreover, the builder also can use various fasteners (nails, adhesive, screws, rivets, etc.) to secure the wall-mounted connector 220 to the wall 110*a*. For example, the builder can use screws 275 to fasten the wall-mounted connector 220 to the wall 110*a*. Similarly, screws can couple the trim-mounted connector 230 to the trim 200.

In light of this closure, those skilled in the art should appreciate that other fasteners can couple the wall-mounted connector 220 to the wall 110*a* as well as the trim-mounted connector 230 to the trim 200. Moreover, as described above, the wall 110*a* can incorporate the wall-mounted connector 220 (e.g., the manufacturer can prefabricate the wall 110*a* together with the wall-mounted connectors, such as the wall-mounted connector 220). Likewise, the trim 200 can incorporate the trim-mounted connector 230, which, in some instances, may be integrated into the trim 200.

The wall-mounted connector 220 and the trim-mounted connector 230 can comprise suitable rigid and flexible or resilient materials. For example, the wall-mounted connector 220 can comprise aluminum, steel, thermoplastic (e.g., reinforced thermoplastic). More specifically, the manufacturer can fabricate an aluminum extrusion that has a desired profile, which can allow the trim-mounted connector 230 to connect to the wall-mounted connector 220.

Similar to the wall-mounted connector 220, the trim-mounted connector 230 also can comprise, for instance, aluminum, steel (e.g., spring steel), reinforced thermoplastic, etc. Thus, at least a portion of the trim-mounted connector 230 can deflect in response to contact with the wall-mounted connector 220 and at least partially retract back to its original position, thereby securing the trim-mounted connector 230 to the wall-mounted connector 220. In any event, however, the wall-mounted connector 220 and the trim-mounted connector 230 can have sufficient flexibility, resiliency, and strength to couple together as well as to safely secure the trim 200 to the wall 110*a*.

The wall-mounted connector 220 and the trim-mounted connector 230 may have any suitable height, width, and length (into the plane of view illustrated in FIGS. 2, 2A, and 2B), which may vary from one implementation to another. For example, the length of either or both of the wall-mounted connector 220 and the trim-mounted connector 230 may be in the range of 0.25" to 5". In some examples, either or both of the wall-mounted connector 220 and the trim-mounted connector 230 may be an extrusion. Accordingly, the installer or manufacturer may select any suitable length for the wall-mounted connector 220 and for the trim-mounted connector 230

Figure 3:
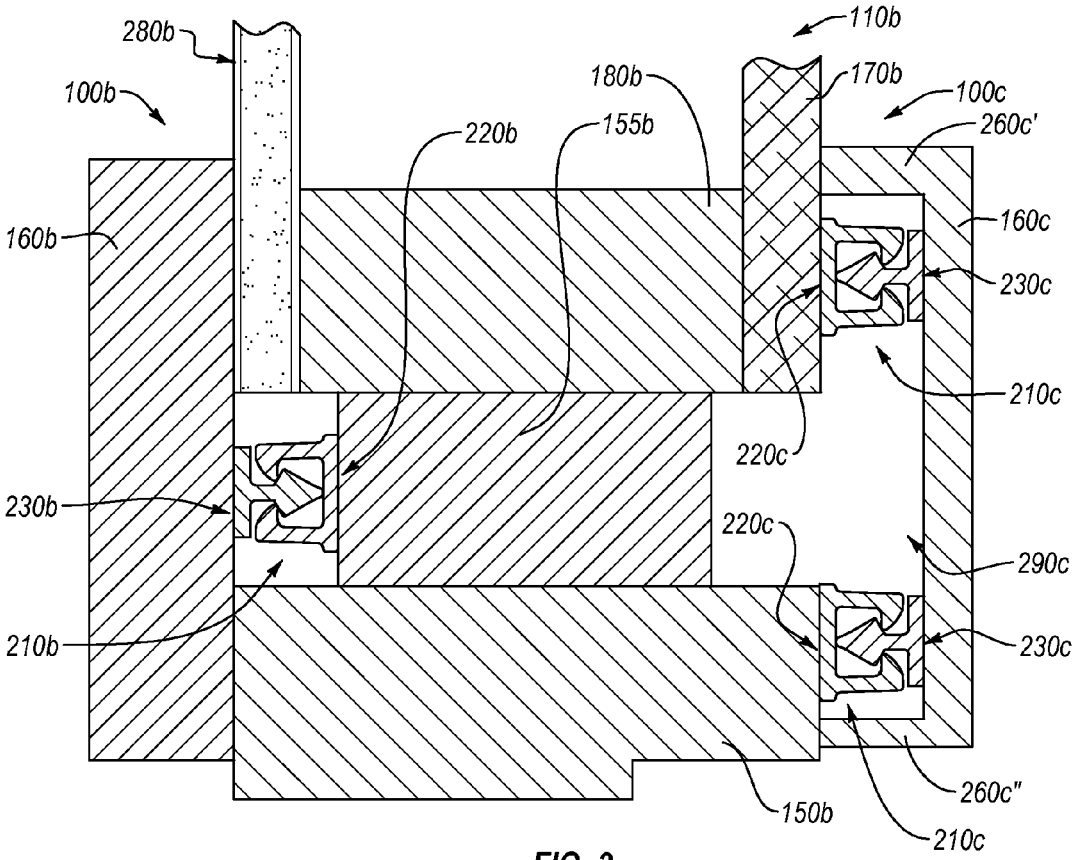
FIG. 3 illustrates a cross-sectional view of a quick-connect trim system in accordance with another implementations of the present invention.
Figure 2A:
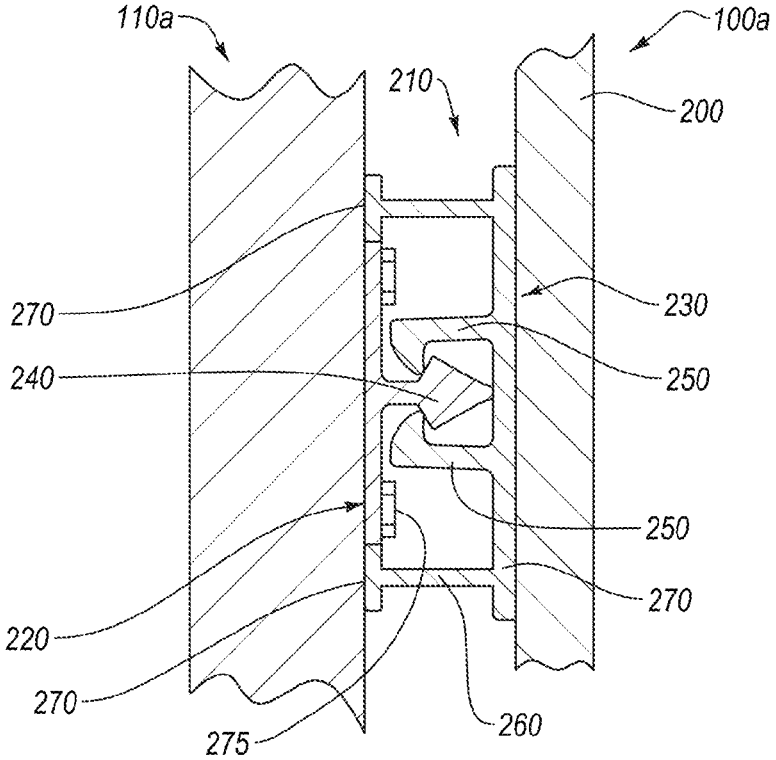
Figure 2B:
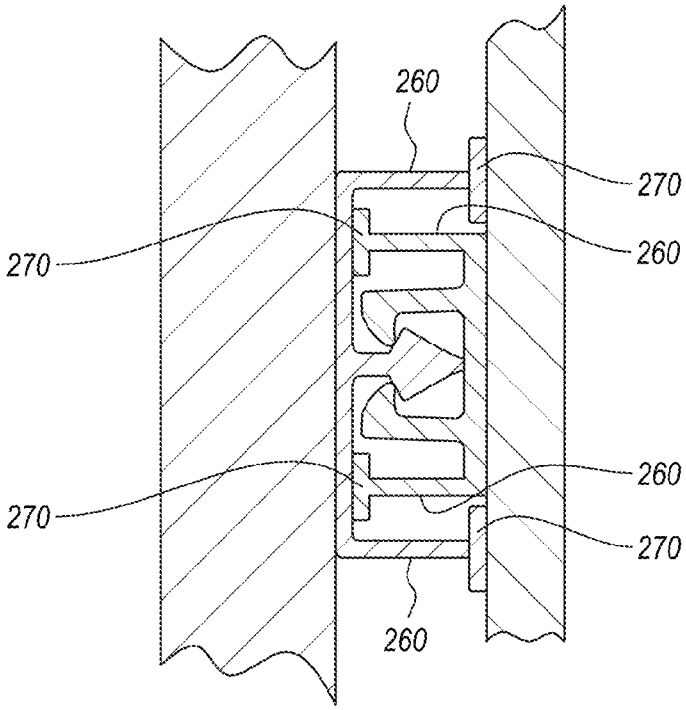

One will appreciate that the quick-connect trim systems shown and described in relation to FIGS. 2, 2A, and 2B are only exemplary implementations. In other words, the exact structure and layout of the quick-connect trim system can vary from the implementations shown in FIGS. 2, 2A, and 2B. For example, in one or more implementations the wall-mounted connector comprises a female member and the trim-mounted connector comprises a male member. FIG. 3 illustrates one example of such configuration. More specifically, FIG. 3 illustrates a quick-connect trim system 100*b* that may include a trim connector assembly 210*b* comprising a male-type trim-mounted connector 230*b* and a female-type wall-mounted connector 220*b*. Except as otherwise described herein, the quick-connect trim system 100*b* and its materials, elements, or components can be similar to or the same as any of the quick-connect trim systems 100, 100*a* (FIGS. 1-2B) and their respective materials, elements, and components.

For example, the wall-mounted connector 220*b* can connect to a spacer 155*b*, which can space a head jamb 150*b* from an interior structural portion 180*b* of a wall 110*b*. As described above, the wall 110*b* may include the interior structural portion 180*b* and an interior cladding layer 280*b*, such as drywall and the like. In one implementation, the wall-mounted connector 220*b* can connect to or be integrated with the spacer 155*b*. Accordingly, the installer can provide quick-connection for a casing trim 160*b* by positioning and/or securing the spacer 155*b* in a space between the interior structural portion 180*b* (e.g., wall header) and the head jamb 150*b*. In additional or alternative implementations, the wall-mounted connector 220*b* may connect to the head jamb 150*b*, cladding layer 280*b*, interior structural portion 180*b*, spacer 155*b* and combinations thereof.

In any event, the casing trim 160*b* can connect to the wall 110*b* via the connection between the trim-mounted connector 230*b* and the wall-mounted connector 220*b*. In one example, the trim-mounted connector 230*b* may protrude outward from an inside surface of the casing trim 160*b*. Accordingly, the wall 110*b* can include sufficient space to accommodate at least a portion of the trim-mounted connector 230*b* as well as the wall-mounted connector 220*b*, to facilitate connecting the casing trim 160*b* flush with the cladding layer 280*b* and/or with the head jamb 150*b*.

Alternatively, in at least one implementation, a quick-connect trim system 100*c* can include a casing trim 160*c* that has a recess 290*c*, which can accommodate a trim-mounted connector 230*c* as well as a wall-mounted connector 220*c* therein. Except as otherwise described herein, the quick-connect trim system 100*c* and its materials, elements, or components can be similar to or the same as any of the quick-connect trim systems 100, 100*a* (FIGS. 1-2) and the quick-connect trim system 100*b* and their respective materials, elements, and components. For example, the quick-connect trim system 100*c* may include a trim connector assembly 210*c* comprising the trim-mounted connector 230*c* and the wall-mounted connector 220*c*, which may be similar to or the same as the trim connector assembly 210*b*.

In some implementations, the recess 290*c* may be sufficient to completely enclose the trim-mounted connector 230*c*, such that the trim-mounted connector 230*c* resides below a surface that contacts and/or seals against the wall 110*b* or portion(s) thereof. Similarly, the recess 290*c* also may enclose at least a portion of one or more of the wall-mounted connectors 220*c*. As such, the installer can mount the wall-mounted connector 220*c* on the wall 110*b* in a manner that allows the wall-mounted connector 220*c* to protrude past an outer surface of the wall 110*b*. As mentioned above, the wall 110*b* may include various cladding layers, such as an exterior cladding layer 170*b*. In one implementation, the wall-mounted connector 220*c* can protrude past an outer surface of the cladding layer 170*b*.

In one or more implementations, the installer can mount the wall-mounted connector 220*c* directly to the cladding layer 170*b*. In additional or alternative implementations, the wall-mounted connector 220*c* can connect to the head jamb 150*b*. In any case, the wall-mounted connector 220*c* can connect to the cladding layer 170*b*, head jamb 150*b*, spacer 155*b*, and combinations thereof.

As described above, the quick-connect trim system 100*c* may include one or more tensioning members, which can enhance security and stability of the connection between the trim 160*c* and the wall 110*b*. Furthermore, the tensioning members may be connected to or integrated with the casing trim 160*c*. Particularly, in one example, the casing trim 160*c* may include upper and lower tensioning members 260*c*', 260*c*", which may press against the wall 110*b*, thereby pushing the casing trim 160*c* and the trim-mounted connector 230*c* away from the wall 110*b*. Hence, the upper and lower tensioning members 260*c*', 260*c*" can force the coupling features of the trim-mounted connector 230*c* against the coupling features of the wall-mounted connector 220*c*, in a manner described above.

Additionally, the upper and lower tensioning members 260*c*', 260*c*" can exhibit different resistance to force. For instance, the upper tensioning member 260*c*' may be thicker than the lower tensioning member 260*c*". Hence, the upper tensioning member 260*c*' may be more resistant to deflection or bending than the lower tensioning member 260*c*". As such, connecting the casing trim 160*c* to the wall 110*b* may angle or pivot the casing trim 160*c* due to different deflection of the upper and lower tensioning members 260*c*', 260*c*".

Additionally, the recess 290*c* also can facilitate securing utility lines within the casing trim 160*c* and/or between the casing trim 160*c* and the wall 110*b*. For example, the installer can position and secure electrical, communication, water, and other utility lines as well as combinations thereof within the recess 290*c*. Consequently, in addition to concealing or covering unfinished edges of the wall 110*b*, the casing trim 160*c* also may secure and/or conceal utility lines.

As described above, it should be appreciated that any trim element can connect to any portion of the wall 110*b* as well as to any other trim element. Thus, the quick-connect trim system can connect any combination of trim (e.g., casing trim 160*b*, casing trim 160*c*, head jamb 150*b*, etc.) to the wall 110*b* as well as to each other. For example, the installer can nail, screw, or otherwise secure or fasten the head jamb 150*b* to the spacer 155*b* and/or to the interior structural portion 180*b*, to secure the head jamb 150*b* to the wall 110*b*. In one or more implementations, the installer also can use the quick-connect trim system to secure the head jamb 150*b* to the wall 110*b*. For example, the wall- and trim-mounted connectors can connect the head jamb 150*b* to the interior structural portion 180*b* and/or to the spacer 155*b*. It should be appreciated, that the installer can also connect the spacer 155*b* to the interior structural portion 180*b* with one or more wall- and trim-mounted connectors.

It should be noted that although in at least one implementation, the wall-mounted connector and the trim-mounted connector can form a snap or clip fit, this disclosure is not so limited. For instance, the wall-mounted connector can incorporate coupling features that have one or more grooves that can receive a spring-loaded ball located in the coupling features of the trim-mounted connector. Additionally or alternatively, the wall-mounted connector and the trim-mounted connector can have corresponding coupling features and coupling features that have matching locking tapers, which, after engagement one with the other, can couple the trim-mounted connector to the wall-mounted connector. In still further implementations, the quick-connect trim system can comprise a channel into which a protrusion can connect.

Figure 4:
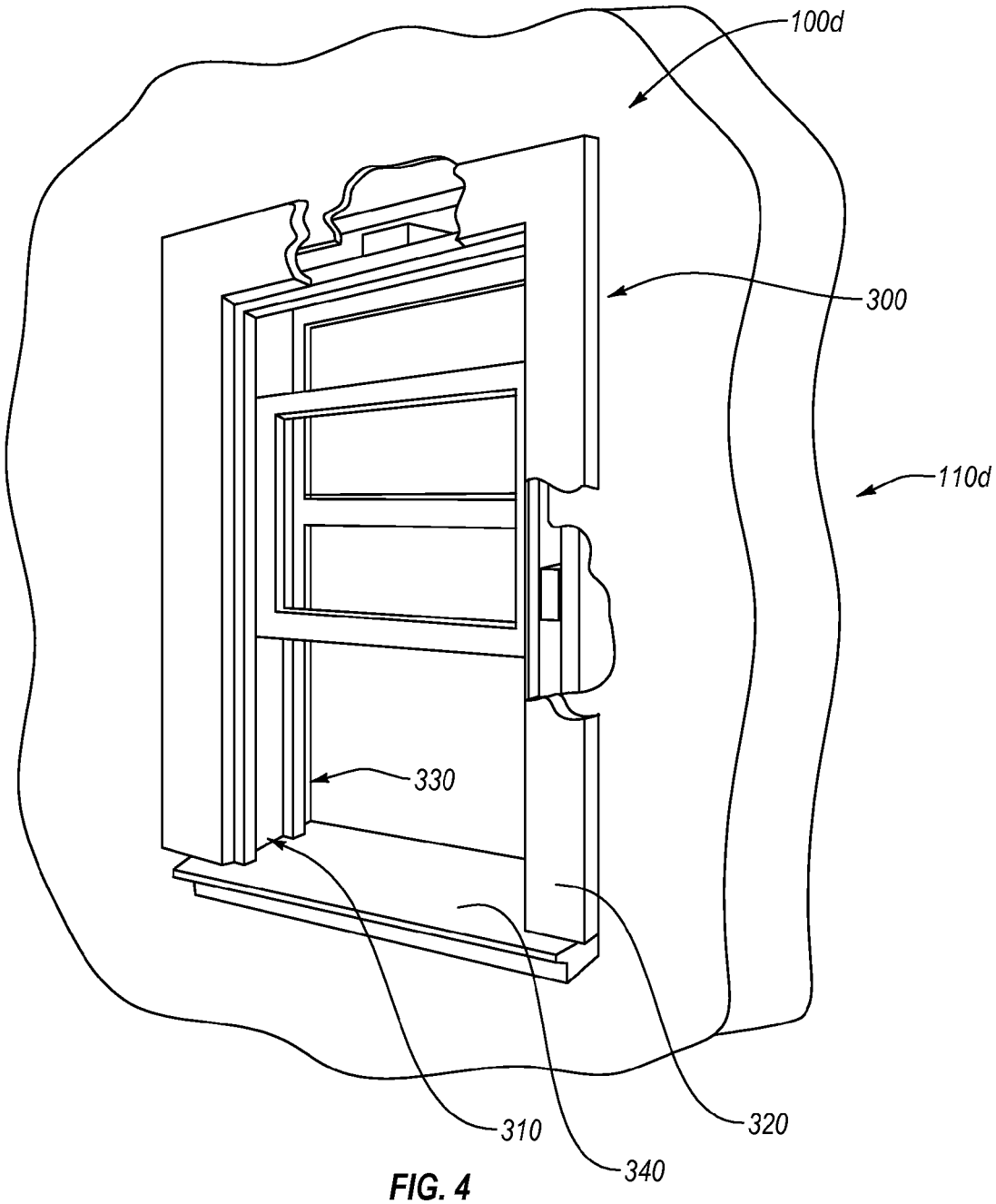
FIG. 4 illustrates a perspective view of a quick-connect trim system in accordance with yet another implementation of the present invention.

As described above, the trim can comprise various elements or components installed or secured to the wall. Examples of such elements include various portions of a doorway, described in connection with FIG. 1. This invention, however, is not so limited. Accordingly, the builder can secure other elements of trim to the wall with the quick-connect trim connector assembly. For instance, FIG. 4 illustrates additional or alternative elements and/or components that the installer can connect to a wall with the quick-connect trim system. Particularly, as illustrated in FIG. 4, the trim can include various portions of a window frame assembly 300, which form the quick-connect trim system 100*d*. Except as otherwise described herein, the quick-connect trim system 100*d* and its materials, elements, or components can be similar to or the same as any of the quick-connect trim systems 100, 100*a*, 100*b*, 100*c* (FIG. 1-3) and their respective materials, elements, and components.

For example, the builder can couple various portions of the window frame assembly 300 with the trim connector assembly (e.g., trim connector assembly 210, 210*b*, 210*c* (FIGS. 2-3)) to the wall 110*d*. For instance, the builder can use the trim connector assembly to secure a window frame 310 to the wall 110*d*. Similarly, the builder also can use the trim connector assembly to secure an outside trim 320, inside trim 330, and a window sill 340 to the wall 110*d*.

Figure 5:
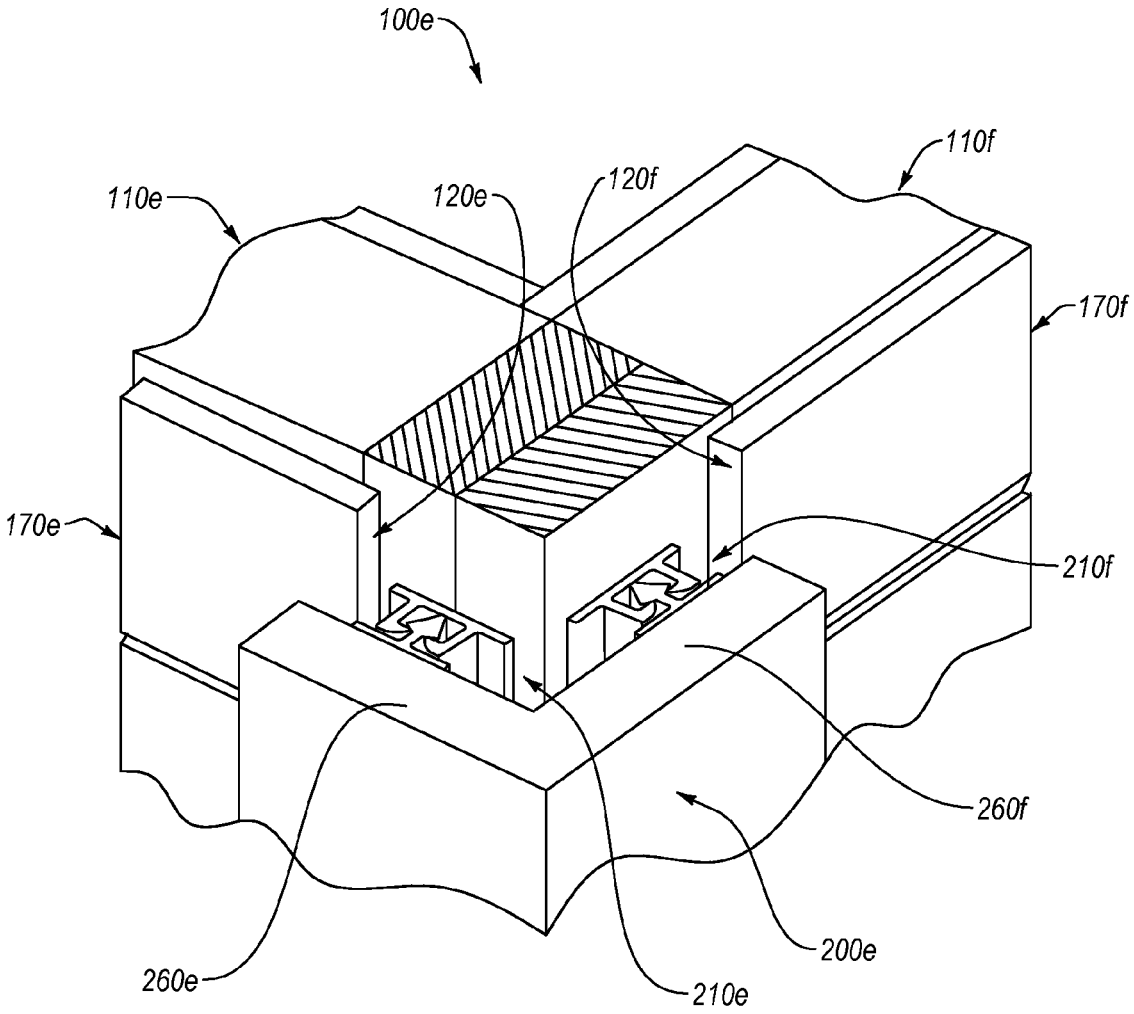
FIG. 5 illustrates a perspective view of a quick-connect trim system in accordance with still one other implementation of the present invention.

Furthermore, in light of this disclosure, those skilled in the art should appreciate that the builder can use the trim connector assemblies to secure other elements of trim to the wall. FIG. 5 illustrates another example of a quick-connect trim system. Particularly, FIG. 5 illustrates a quick-connect trim system 100*e*, which includes a corner trim 200*e* connected to walls 110*e*, 110*f* that form a corner of a building. Except as otherwise described herein, the quick-connect trim system 110*e* and its materials, elements, or components can be similar to or the same as any of the quick-connect trim systems 100, 100*a*, 100*b*, 100*c*, 100*d* (FIG. 1-4) and their respective materials, elements, and components. For example, the quick-connect trim system 100*e* can include trim connector assemblies 210*e*, 210*f*, which may be similar to or the same as any of the trim connector assemblies 210, 210*b*, 210*c* (FIGS. 2-3).

As described above, the walls 110*e*, 110*f* can include corresponding external cladding layers 170*e*, 170*f*. In some instances, the cladding layers 170*e*, 170*f* may have corresponding unfinished edges 120*e*, 120*f* at the corner formed by the walls 110*e*, 110*f*. Accordingly, the installer can secure the corner trim 200*e* to conceal and/or protect the unfinished edges 120*e*, 120*f* of the cladding layers 170*e*, 170*f*. Specifically, the trim connector assemblies 210*e*, 210*f* can secure the corner trim 200*e* to the walls 110*e*, 110*f*. In one example, the trim connector assembly 210*e* can secure a first portion 260*e* of the corner trim 200*e* to either or both walls 110*e*, 110*f*. Likewise, the trim connector assembly 210*f* can secure a second portion 260*f* of the corner trim 200*e* to either or both walls 110*e*, 110*f*.

In one or more implementations, the first and second portions 260*e*, 260*f* can be oriented relative to each other at a similar or the same angle as the orientation of the walls 110*e*, 110*f* (e.g., at 90°). Alternatively, the angle between the first and second portions 260*e*, 260*f* can be smaller or greater than the angle formed between the walls 110*e*, 110*f*. Moreover, in one example, the angle between the first and second portions 260*e*, 260*f* can be smaller than the angle between the walls 110*e*, 110*f*, and the first and second portions 260*e*, 260*f* may be or may function as tensioning members (similar to the tensioning members 260, 260*c*', 260*c*" (FIGS. 2-3). Particularly, for instance, the first and second portions 260*e*, 260*f* can press against the respective walls 110*e*, 110*f* (e.g., against respective cladding layers 170*e*, 170*f*).

As such, the first and second portions 260*e*, 260*f* of the corner trim 200*e* can form a seal against the respective cladding layers 170*e*, 170*f*. Hence, such configuration of the corner trim may protect interior portions of the walls 110*e*, 110*f* as well as provide a pleasing aesthetic by substantially completely concealing the unfinished edges 120*e*, 120*f* of the respective cladding layers 170*e*, 170*f*.

In addition, as the first and/or second portions 260*e*, 260*f* press against the respective walls 110*e*, 110*f*, the corner trim 200*e* can produce tension between connectors of the trim connector assemblies 210*e*, 210*f*. Specifically, as described above, the trim connector assemblies can include trim- and wall-mounted connectors that can engage and couple together. Consequently, first and/or second portions 260*e*, 260*f* of the corner trim 200*e* can force the trim- and wall mounted connectors of the connector assemblies 210*e*, 210*f* against each other (similar to the tensioning members 260 (FIGS. 2, 2A, and 2B)). In one example, the coupling features of the trim- and wall-mounted connectors may be in tension, applied in a direction opposite to the engagement direction (i.e., direction of movement of the trim-mounted connector during engagement of and coupling to the wall-mounted connector). In any case, however, the connector assemblies 210*e*, 210*f* can securely couple the corner trim 200*e* to the walls 110*e*, 110*f*.

The corner trim 200*e* can include or comprise any suitable material, which can vary from one implementation to another. In some instances, the corner trim 200*e* can comprise sufficiently flexible and resilient material, which can have spring-like characteristics. For instance, the corner trim 200*e* can include plastic (e.g., reinforced plastic) material that may be sufficiently resilient.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A quick-connect trim system for securing elements of trim to a structural wall of a building, about one or more of interior and exterior portions of the structural wall, the system comprising:

an element of trim;

one or more wall-mounted connectors securable to or integrated with a portion of the wall of the building, the one or more wall-mounted connectors including one or more first coupling features and further including one or more tensioning members adapted to flex against the element of trim, the tensioning members comprising first and second tensioning members disposed on opposing sides of the one or more first coupling features; and one or more trim-mounted connectors secured to or integrated with the element of trim, the one or more trim-mounted connectors including one or more second coupling features;

wherein:

the one or more first coupling features are coupleable with the one or more second coupling features to couple the one or more wall-mounted connectors with the one or more trim-mounted connectors; and one or more of the one or more trim-mounted connectors include first and second tensioning members disposed on opposing sides of the one or more second coupling features, the first and second tensioning members being adapted to flex against the wall of the building to push the element of trim away from the one or more wall-mounted connectors and place the one or more first coupling features and the one or more second coupling features in tension one with another.

2. The system as recited in claim 1, wherein the element of trim is a conventional element of trim and the one or more trim-mounted connectors are secured to the conventional element of trim.

3. The system as recited in claim 1, wherein the first and second tensioning members extend between the element of trim and the wall of the building.

4. The system as recited in claim 1, wherein the one or more first coupling features include undercutting portions adapted to snap into undercutting portions of the one or more second coupling features.

5. The system as recited in claim 1, wherein the one or more wall-mounted connectors and the one or more trim-mounted connectors position and orient the element of trim at a predetermined position and orientation.

6. The system as recited in claim 1, wherein the one or more wall-mounted connectors further comprise one or more feet connected to or integrated with the tensioning members, the one or more feet being adapted to press against the element of trim.

7. The system as recited in claim 1, wherein the one or more trim-mounted connectors further comprise first and second feet connected to or integrated with the first and second tensioning members, respectively, the first and second feet being adapted to press against the wall of the building.

8. The system as recited in claim 1, wherein the element of trim is adapted to conceal one or more unfinished edges of a cladding layer on the wall.

9. The system as recited in claim 1, wherein the element of trim is selected from the group consisting of a door casing, a window casing, a door jamb, a threshold, and a corner trim.

10. A prefabricated wall unit ready for on the job site installation for forming at least a portion of a wall of a building, the prefabricated wall unit comprising:

a structural wall module including one or more openings that have a shape and size to accommodate a door or window, the structural wall module being sized and configured to form at least a portion of a wall of a building;

one or more wall-mounted connectors secured to the structural wall module and positioned near the one or more openings, the wall-mounted connectors including one or more first coupling features and further including one or more tensioning members adapted to flex against one or more elements of trim, the tensioning members comprising first and second tensioning members disposed on opposing sides of the one or more first coupling features;

the one or more elements of trim having one or more trim-mounted connectors secured thereto or integrated therewith, the trim-mounted connectors being connectable to the one or more wall-mounted connectors; and first and second tensioning members disposed on opposing sides of the one or more wall-mounted connectors and the one or more trim-mounted connectors, the first and second tensioning members being adapted to be flexibly compressed between at least one of the one or more elements of trim and the structural wall module to push the at least one of the one or more elements of trim away from the structural wall module and place the one or more wall-mounted connectors and the one or more trim-mounted connectors in tension one with another.

11. The prefabricated wall unit as recited in claim 10, wherein the one or more elements of trim comprise conventional elements of trim having the one or more trim-mounted connectors fastened thereto.

12. The prefabricated wall unit as recited in claim 10, wherein at least one of the one or more elements of trim comprises at least a portion of a door jamb or a window frame.

13. The prefabricated wall unit as recited in claim 10, wherein at least one of the one or more elements of trim comprises at least a portion of a door casing or a window casing.

14. The prefabricated wall unit as recited in claim 1, wherein:

the one or more wall-mounted connectors include one or more first coupling features; and the one or more trim-mounted connectors include one or more second coupling features adapted to be coupled to the one or more first coupling features, the first and second coupling features being tensioned against each other by the first and second tensioning members.

15. The prefabricated wall unit as recited in claim 10, wherein the structural wall module is sized and configured to form at least a portion of an exterior wall of the building.

* * * * *

UNITED STATES PATENT AND TRADEMARK OFFICE

CERTIFICATE OF CORRECTION

PATENT NO. : 9,206,612 B2
APPLICATION NO. : 14/249260
DATED : December 8, 2015
INVENTOR(S) : Gosling et al.

It is certified that error appears in the above-identified patent and that said Letters Patent is hereby corrected as shown below:

In the Specification

Column 6
Line 55-56, change "wall-mounted connector 230" to --wall-mounted connector 220--

Column 10
Line 30, change "engagement one" to --engagement of one--

Signed and Sealed this
Fourteenth Day of June, 2016

Michelle K. Lee

Michelle K. Lee
*Director of the United States Patent and Trademark Office*